United States Patent [19]

Krämer

[11] 4,359,986

[45] Nov. 23, 1982

[54] CONTROL APPARATUS FOR INTERNAL COMBUSTION ENGINES, IN PARTICULAR A CORRECTION DEVICE DEPENDENT ON CHARGE PRESSURE FOR SUPER-CHARGED DIESEL VEHICLE ENGINES

[75] Inventor: Manfred Krämer, Schwieberdingen, Fed. Rep. of Germany

[73] Assignee: Robert Bosch GmbH, Stuttgart, Fed. Rep. of Germany

[21] Appl. No.: 167,618

[22] Filed: Jul. 11, 1980

[30] Foreign Application Priority Data

Sep. 7, 1979 [DE] Fed. Rep. of Germany ..... 2936162

[51] Int. Cl.[3] ..... F02D 1/06; F02D 1/14

[52] U.S. Cl. ..... 123/383; 123/380; 123/370

[58] Field of Search ..... 123/383, 382, 391, 381, 123/393, 367, 380, 370, 371

[56] References Cited

U.S. PATENT DOCUMENTS

| | | | |
|---|---|---|---|
| 2,031,527 | 2/1936 | Dodson | 123/383 |
| 2,374,411 | 4/1945 | Camner | 123/383 |
| 2,999,488 | 9/1961 | Reggio | 123/383 |
| 3,077,873 | 2/1963 | Parks | 123/383 |
| 3,435,813 | 4/1969 | Wagner | 123/383 |
| 3,960,127 | 6/1976 | Juaille | 123/383 |
| 4,037,575 | 7/1977 | Sommars | 123/367 |
| 4,148,289 | 4/1979 | Hewitt | 123/198 D |
| 4,228,774 | 10/1980 | Ritter | 123/383 |

*Primary Examiner*—Charles J. Myhre
*Assistant Examiner*—Carl Stuart Miller
*Attorney, Agent, or Firm*—Edwin E. Greigg

[57] ABSTRACT

A control apparatus for internal combustion engines is proposed, in which the adjustment range or the full-load position of a supply quantity adjustment member of the fuel metering apparatus is varied in accordance with the absolute pressure of the aspirated air in the suction tube of the engine in order to attain optimal combustion at the greatest possible torque. The control apparatus (FIG. 1) includes a pneumatic pressure converter and a pneumatic adjustment member. The pneumatic pressure converter, in a first pressure chamber, contains an evacuated diaphragm pressure box exposed to the aspirated air pressure ($p_L$), which acts counter to a second diaphragm pressure box exposed in its interior to atmospheric air pressure ($p_A$) and located in a second pressure chamber connected to a compressed air source. Both pressure boxes are connected via an actuation member supporting a valve member, and the valve member reduces the servo air pressure ($p_S$) to a control air pressure ($p_{St}$) which is proportional to the absolute aspirated air pressure ($p_LK$), this control air pressure actuating the diaphragm adjustment member functioning counter to a restoring spring and to atmospheric air pressure.

12 Claims, 5 Drawing Figures

CONTROL APPARATUS FOR INTERNAL COMBUSTION ENGINES, IN PARTICULAR A CORRECTION DEVICE DEPENDENT ON CHARGE PRESSURE FOR SUPER-CHARGED DIESEL VEHICLE ENGINES

BACKGROUND OF THE INVENTION

The invention relates to a control apparatus for internal combustion engines.

Known control apparatuses of this kind (German laid-open applications Nos. 24 48 656 and 24 32 830) function in accordance with the absolute pressure of the aspirated air in the suction tube of the engine; in aspirating engines, that is, they function in accordance with atmospheric pressure, and in supercharged engines they function in accordance with the charge air pressure. Because of the limited work capacity of the diaphragm pressure boxes which process the absolute pressure of the aspirated air, the adjusting member of this apparatus, having a movable wall, is preceded by a control device, in which the position of a valve member for controlling a servo pressure medium is determined by an evacuated diaphragm pressure box exposed to the aspirated air pressure. This control device functions as a hydraulic follower-piston unit, and the diaphragm pressure box must generate either a control path corresponding to the required adjusting-member path for twisting an adjuster eccentric or, in the case of the German laid-open application No. 25 32 830, a control path such as is required for displacing a three-dimensional cam. This sometimes requires relatively long adjustment paths, which involve friction, and thus also necessitates correspondingly large diaphragm box sets. Furthermore, the supply and sealing of the structural elements exposed to the hydraulic medium represents a relatively great expense.

Other known control apparatuses, which functions without a servo medium and include adjustment members directly exposed to the diaphragm pressure boxes, likewise have much too little work capacity, and the necessary adjustment paths are difficult to attain. Control apparatuses are also known whose diaphragm adjustment members, exposed directly to the charge air pressure, by contrast do have a larger work capacity; however, they work only with the differential pressure between the charge air pressure and atmospheric pressure and cannot furnish any absolute pressure signal such as is required in order to prevent impermissible smoke generation, especially when the engine is operated in areas of extreme variations in altitude.

The adjustment members of the known control apparatuses either engage the governor linkage, in order to adapt the governor characteristic in accordance with the varying absolute pressure of the aspirated air, or, acting as a full-load stop, they limit the particular permissible full-load position of a supply quantity adjustment member of the fuel metering apparatus.

OBJECT AND SUMMARY OF THE INVENTION

The control apparatus according to the invention has the advantage over the prior art that, because compressed air is used as the servopressure medium, no problems with sealing arise; also, depending upon the design of the pneumatic pressure converter, the control air pressure which is proportional to the absolute pressure of the aspirate air can be translated to a pressure level which is high enough to produce the necessary work capacity. Furthermore, the known diaphragm adjustment members, otherwise directly actuated by the charge air pressure, can be used as the adjustment members.

As a result of the characteristics disclosed herein, advantageous improvements to and modifications of the control apparatus disclosed are possible. With the combination of characteristics given herein, despite the use of an adjustment member functioning counter to ambient or atmospheric air pressure, it is possible without great expense to control a precise correction, proportional to the absolute pressure of the aspirated air, of the adjustment range or of the full-load position of the supply quantity adjustment member of the fuel metering apparatus. By using two diaphragm pressure boxes, it is possible to attain a very simple structure for the pneumatic pressure converter, and the pressure translation to be selected can be determined by means of selecting the diaphragm pressure box size without changing any other structural elements; as a result, either the adjustment member remains identical while the work capacity is increased, or the adjustment member can be reduced in size while the work capacity remains the same.

By using the bounce plate valve disclosed, a very precise control of the control air pressure is attainable with very small actuation paths. Using the characteristics set forth herein, the quantity of air flowing out during the control of the control air pressure proceeds into the first pressure chamber communicating with the intake tube, so that a release of the control air into the engine chamber is prevented, or an additional discharge line becomes superfluous. As a result, it is possible to attain a shift of the effective control air pressure range to a desired pressure range in a simple manner, and the use of a known diaphragm adjustment member is disclosed.

The invention will be better understood and further objects and advantages thereof will become more apparent from the ensuing detailed description of preferred embodiments taken in conjunction with the drawings.

BRIEF DESCRIPTION OF THE DRAWINGS

In simplified form, the drawings show.

DESCRIPTION OF THE PREFERRED EMBODIMENTS

Figure 1:
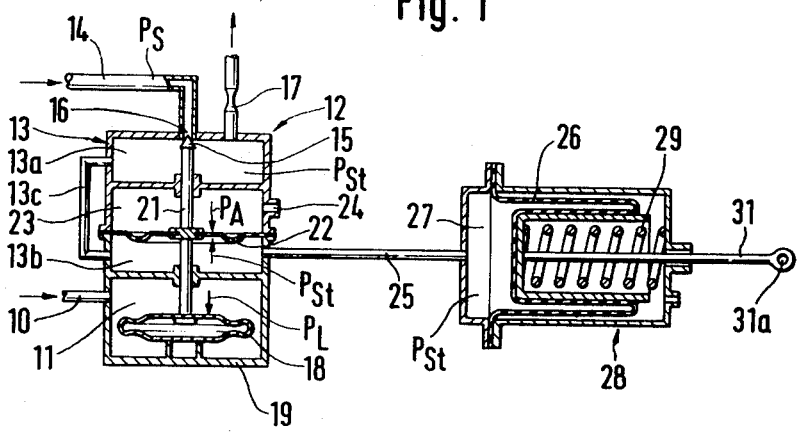
FIG. 1, a first exemplary embodiment serving to explain the basic function of the apparatus.

The exemplary embodiment shown in FIG. 1 serves the purpose of explaining the basic function of the control apparatus according to the invention. This apparatus serves in particular as a charge-pressure-dependent correction apparatus for supercharged Diesel vehicle engines. Adjoining a charge air line 10 communicating with the suction tube of the engine (not shown) is a first pressure chamber 11 of a pneumatic pressure converter 12 functioning in the manner of a pneumatic pressure scale and acting as the control apparatus. A servo air line 14 is connected to the second pressure chamber 13 thereof, which is made up of two partial chambers 13*a* and 13*b* which communicate with one another. By way of the servo air line 14, compressed air acting as the servo pressure medium and preferably derived from an air brake system is delivered into partial chamber 13*a* by means of an inlet opening 16 controlled by a valve member 15; a portion of this compressed air continuously flows out of this partial chamber via a discharge opening 17 embodied as an outflow throttle.

An evacuated diaphragm pressure box 18 is disposed in the first pressure chamber 11 and, exposed to the charge air pressure $p_L$ delivered via the charge air line 19, is secured on one side to a housing 19 of the pressure converter 12 and on the other side to an actuation member 21 provided with the valve member 15. The actuation member 21 is furthermore connected with a control diaphragm 22 defining the partial chamber 13*b* of the second pressure chamber 13. The control diaphragm 22 is exposed by way of a third pressure chamber 23, disposed between the two partial chambers 13*a* and 13*b*, to the atmospheric air pressure $p_A$ which reaches this pressure chamber 23 via an aperture 24. The second pressure chamber 13 communicates by way of the partial chamber 13*b* and a line 25 with a work chamber 27 of an adjustment member 28. The work chamber 27 is defined by a rolled diaphragm 26. The rolled diaphragm 26, which as a movable wall is exposed to the control air pressure $p_{St}$ delivered to the work chamber, actuates an adjusting rod 31 counter to the force of a restoring spring 29. The adjusting rod 31 engages the governor linkage of an rpm governor, not shown in detail, in a known manner via an articulation point 31*a*, or it actuates a pivotable or displaceable full-load stop for limiting the position of a supply quantity adjustment member of the fuel metering apparatus.

The evacuated diaphragm pressure box 18 exposed to the aspirated air pressure $p_L$ acts counter to the control diaphragm 22 exposed to the control air pressure $p_{St}$, and both diaphragm elements 18 and 22 determine the position of the actuation member 21 which governs the control air pressure $p_{St}$, and thus the position of the valve member 15. If the compressed air continuously flows out of the second pressure chamber 13 via the fixedly set discharge throttle 17, then, when there is a state of balance between the actuation forces exerted upon the actuation member 21 by the diaphragm pressure box 18 and the control diaphragm 22, the control air pressure $p_{St}$ prevailing in the pressure chamber 13 is controlled in proportion to the absolute pressure of the aspirated air delivered via the charge air line 10 into the first pressure chamber 11, because the inlet cross section of the inlet opening 16 is set by the valve member 15 in accordance with the control air pressure $p_{St}$ to be controlled. When there is a pressure increase in the first pressure chamber 11, this inlet cross section is enlarged; when there is a pressure drop, the inlet cross section is reduced in size. Because the control air pressure $p_{St}$ is directly proportional to the absolute pressure of the aspirated air and is always an overpressure at a level above the minimum atmospheric pressure, a conventionally available diaphragm adjustment member 28 functioning counter to atmospheric pressure can be used as the adjustment member, as shown here.

In the exemplary embodiments shown in FIGS. 2–5, the structural elements remaining the same or functioning the same as those of FIG. 1 are given identical reference numerals, while those whose structure is altered are provided with a prime.

Figure 2:
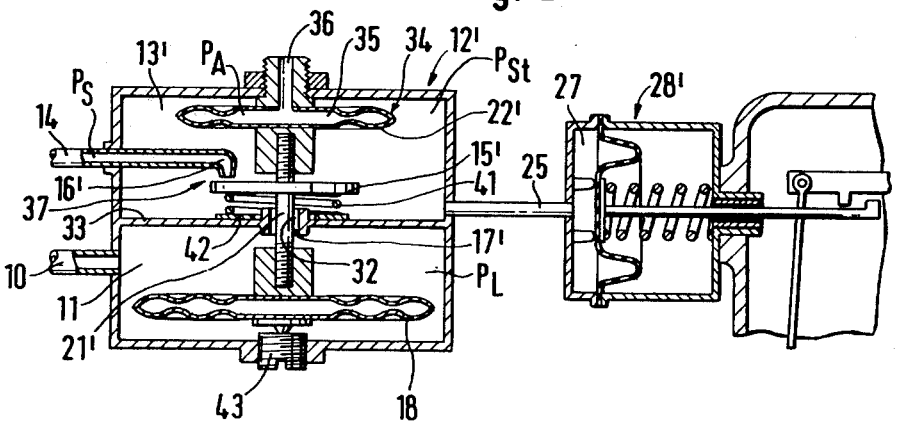
FIG. 2, a second example containing the essential characteristics of a practially realized control apparatus.

The second exemplary embodiment shown in FIG. 2 shows the essential characteristics of a practically realized control apparatus having a pneumatic pressure converter 12' and a diaphragm adjustment member 28'. In the pneumatic pressure converter 12', the second pressure chamber 13' is a single control chamber and it is separated from the first pressure chamber 11 by a partition 33 containing the sliding guide 32 for the actuation member 21'. The control diaphragm exposed to the control air pressure $p_{St}$ and to atmospheric pressure $p_A$, in this exemplary embodiment, is embodied by the wall 22' of a second diaphragm pressure box 34, whose interior 35 is exposed via an aperture 36 to atmospheric air pressure $p_A$ prevailing outside the control apparatus 12'. The actuation member 21' is secured between these two diaphragm pressure boxes 18 and 34 and supports a bounce plate 15', acting as the valve member, of a bounce plate valve 37. This bounce plate 15' controls the flowthrough cross section at an inlet opening 16', which is embodied as a nozzle and is supplied with compressed air at servo air pressure $p_S$ via the servo air line 14. The play provided by the difference in diameter between the sliding guide 32 and the actuation member 21' serves as the discharge opening.

In the embodiment shown in FIG. 2, this discharge opening 17' has a constant throttle cross section, and the pressure variation which is necessary for controlling the control air pressure $p_{St}$ is controlled by varying the cross section at the inlet opening 16'.

The control of the pressure level of the control air pressure $p_{St}$, however, can also be effected by controlling both the inlet and the discharge cross section or by controlling only the discharge cross section when the inlet opening is provided with a throttle; this is described below in connection with FIGS. 3–5, which show such control arrangements.

Figure 3:
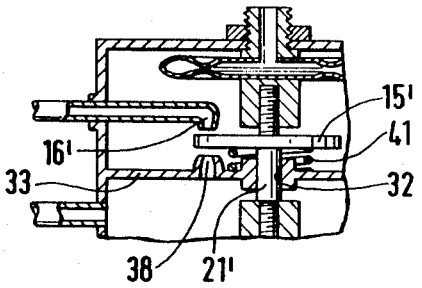
FIG. 3, a partial section through the pneumatic pressure converter shown in FIG. 2, but with the function of the bounce plate valve varied for the third exemplary embodiment.

In the third exemplary embodiment according to FIG. 3, the bounce plate 15' controls both the flowthrough cross section at the inlet opening 16' and the discharge cross section of a discharge opening 38 disposed in the partition 33 and, located opposite the nozzle-like inlet opening 16', this discharge opening 38 is likewise nozzle-like in form. The bore of the sliding guide 32 here acts solely to guide the actuation member 21'. The flowthrough cross sections of the inlet opening 16' and of the discharge opening 38 are controlled alternatively here by means of the valve member 15' in such a fashion that when the inlet cross section enlarges the discharge cross section becomes smaller, and vice versa.

Figure 4:
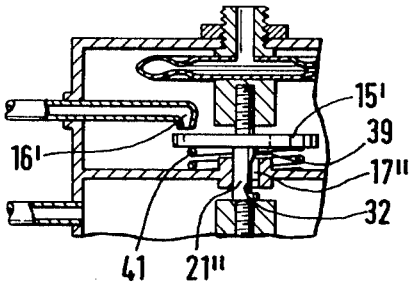
FIG. 4, a partial section through the pneumatic pressure converter shown in FIG. 2, but with the function of the bounce plate valve varied for the fourth exemplary embodiment.

The fourth exemplary embodiment shown in FIG. 4 substantially corresponds to the second exemplary embodiment shown in FIG. 2; however, it is more similar in its function to the third exemplary embodiment shown in FIG. 3, because the actuation member 21'' here is provided with an oblique control face 39, which with the sliding guide 32 controls a discharge cross section of the discharge opening 17'' which is variable via the stroke of the actuation member 21''. In this exemplary embodiment as well, the inlet opening 16' and the discharge opening 17'' function oppositely from one another in terms of the control of their cross sections:

the bounce plate 15' controls the inlet cross section at the inlet opening 16', while the oblique control face 39 of the actuation member 21'' controls the discharge cross section at the discharge opening 17''.

Figure 5:
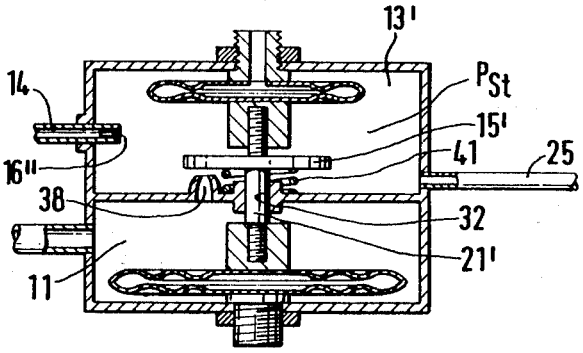
FIG. 5, a pneumatic pressure converter for the fifth exemplary embodiment having a bounce plate valve functioning differently from that of FIG. 2.

In the fifth exemplary embodiment shown in FIG. 5, the inlet opening, supplied with compressed air via the servo air line 14, is embodied as a throttle and given reference numeral 16''. In order to control the control air pressure $p_{St}$ prevailing in the pressure chamber 13', the bounce plate 15' controls only the discharge cross section of the discharge opening 38, which is embodied in the form of a nozzle as in FIG. 3, and the actuation member 21' is guided with little play in the sliding guide 32 in a manner which is low in friction.

In FIGS. 2–5, the valve member 15' is urged in its closing direction by a valve spring 41, the force of whose initial tension causes a parallel displacement of the control air range, as a result of which the control air pressure $p_{St}$ can be adapted to the work pressure of the adjustment member. As shown in FIG. 2, the force of the initial tension of this valve spring 41 can be varied by means of adjusting means 42 for displacing the effective control air pressure range. For the sake of simplicity, the adjusting means is represented as a shim 42; naturally, other adjusting means can also be used, especially infinitely variable adjusting means.

In order to displace the effective control air pressure range and to adjust the position of the valve member 15', the position of installation can also be changed for at least one of the two diaphragm pressure boxes 18 and 34 by means of adjusting means. In the exemplary embodiment shown in FIG. 2, this adjusting means is represented by a compression screw 43 accessible from the outside, which simultaneously serves as a means of axial and radial positioning of the pressure box 18.

By the appropriate selection of the differences in diameter between pressure boxes 18 and 34, for instance with a surface area ratio of 2:1, a pressure translation between the two pressures prevailing in the pressure chambers 11 and 13' in the exemplary embodiments shown in FIGS. 2–5 is attained from $p_L:p_{St2U}=1:2$, and thus a corresponding increase in work capacity is attained. Furthermore, by means of the force of the initial tension of the valve spring 41 and the inherent spring capacity of the pressure boxes 18 and 34, the entire effective control pressure range is fixed such that even the temporary underpressure in the suction tube of the engine, which especially occurs upon acceleration during starting, is reliably translated into a control air pressure $p_{St}$ as required for reliable operation of the adjusting member 28'.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A control apparatus for internal combustion engines, especially a charge-pressure-dependent correction apparatus for supercharged Diesel vehicle engines, said correction apparatus including an adjusting member, a suction tube connected to said correction apparatus, said adjusting member including a movable wall controlled in accordance with absolute pressure of aspirated air from said suction tube and displaceable by a servo air pressure medium connected to said correction apparatus said movable wall arranged to vary an adjustment range or full-load position of a supply quantity adjustment member of a fuel metering apparatus, said correction apparatus further including a valve member, an evacuated diaphragm pressure box, a control means connected to said evacuated diaphragm pressure box which determines the position of said valve member for controlling said servo pressure medium by means of said evacuated diaphragm pressure box exposed to aspirated air pressure, characterized in that compressed air, is used as the servo pressure medium and that the control apparatus comprises a pneumatic pressure converter which reduces the servo air pressure ($p_S$) to a control air pressure ($p_{St}$) proportional to the absolute pressure ($p_L$) of the aspirated air, with the servo air pressure at a higher pressure than the absolute pressure of the aspirated air, said pneumatic pressure converter further includes first and second pressure chambers, said first pressure chamber containing said evacuated diaphragm pressure box which is exposed to aspirated air pressure ($p_L$), a control diaphragm in said second pressure chamber, said control diaphragm being exposed to the control air pressure ($p_{St}$) and arranged to function counter to atmospheric air pressure ($p_A$), means defining an inlet opening in said second chamber which serves to supply the compressed air, and means defining a discharge opening through which compressed air may flow, and further that the flowthrough cross section of at least one of said inlet opening and said outlet opening is variable by said valve member for the purpose of fixing the control air pressure ($p_{St}$), and that said second pressure chamber communicates with a work chamber, defined by said movable wall, of said adjustment member which functions counter to atmospheric air pressure ($p_A$).

2. A control apparatus as defined by claim 1, further wherein said evacuated diaphragm pressure box communicates with an actuation member for said valve member, further characterized in that said control diaphragm likewise communicates with said actuation member, and further that said evacuated diaphragm pressure box actuated by the aspirated air pressure ($p_L$) is arranged to act counter to said control diaphragm which is in turn exposed to said control air pressure ($p_{St}$) and further that said evacuated diaphragm pressure box and said control diaphragm determines the position of said actuation member and said valve member which governs said control air pressure ($p_{St}$).

3. A control apparatus as defined by claim 1, including a second diaphragm pressure box characterized in that said control diaphragm is embodied by one wall of said second diaphragm pressure box, said second diaphragm pressure box having an interior exposed via an aperture to atmospheric air pressure ($p_A$), and said second diaphragm pressure box being surrounded within said second pressure chamber by the flow of the compressed air at control air pressure ($p_{StU}$).

4. A control apparatus as defined by claim 3, characterized in that said actuation member is secured between said pressure actuation boxes and said actuation members further arranged to support a bounce plate, said bounce plate further arranged to open and close said inlet opening in said second chamber.

5. A control apparatus as defined by claim 1, characterized in that said means defining said inlet opening has a variable inlet cross section controlled by said valve member and said means defining said discharge opening is embodied as a discharge throttle.

6. A control apparatus as defined by claim 1, characterized in that said first and second pressure chambers are in close proximity and separated by a partition containing a sliding guide for the actuation member.

7. A control apparatus as defined by claim 6, characterized in that said discharge opening is disposed between said sliding guide and said actuation member.

8. A control apparatus as defined by claim 7, characterized in that said actuation member is provided with a control face which is variable via the stroke of said actuation member.

9. A control apparatus as defined by claim 1, characterized in that the flowthrough cross sections of the means defining said inlet and outlet openings are alternatively controllable by said valve member in such a fashion that when the means defining said inlet cross section increases the means defining said discharge cross section is reduced in size and vice versa.

10. A control apparatus as defined by claim 1, characterized in that said valve member is motivated in its closing direction by a spring means, the force of said spring means being variable by said adjusting member for the purpose of displacing the effective control air pressure range.

11. A control apparatus as defined by claim 3, characterized in that at least one of said two diaphragm pressure boxes is adjustable by a means, said means effective to control air pressure range.

12. A control apparatus as defined by claim 1, characterized in that said adjustment member is arranged to communicate with a work chamber, said work chamber including said movable wall which acts counter to atmospheric air pressure ($p_A$) and counter to a restoring spring.

* * * * *